US007491079B2

(12) United States Patent
Uchida

(10) Patent No.: US 7,491,079 B2
(45) Date of Patent: Feb. 17, 2009

(54) CONNECTOR AND METHOD OF CONNECTING THE SAME

(75) Inventor: Toshio Uchida, Kawasaki (JP)

(73) Assignee: NEC LCD Technologies, Ltd, Kanagawa (JP)

( * ) Notice: Subject to any disclaimer, the term of this patent is extended or adjusted under 35 U.S.C. 154(b) by 46 days.

(21) Appl. No.: 11/822,489

(22) Filed: Jul. 6, 2007

(65) Prior Publication Data

US 2008/0009160 A1 Jan. 10, 2008

(30) Foreign Application Priority Data

Jul. 7, 2006 (JP) ..... 2006-187865

(51) Int. Cl.
*H01R 13/15* (2006.01)

(52) U.S. Cl. ..... 439/265

(58) Field of Classification Search ..... 439/74, 439/660, 265, 259, 261, 197

See application file for complete search history.

(56) References Cited

U.S. PATENT DOCUMENTS 3,588,786 A * 6/1971 Alfero ..... 439/265
4,678,255 A * 7/1987 Carter ..... 439/267

* cited by examiner

*Primary Examiner*—Phuong K Dinh
(74) *Attorney, Agent, or Firm*—Young & Thompson

(57) ABSTRACT

A connector includes i) a plug including a pair of connecting members configured to connect the plug to a socket, a through-hole formed at a portion between the pair of connecting members, and plug contacts arranged on outer side faces of the respective connecting members, ii) a socket including a recess portion configured to receive the plug, and socket contacts arranged on inner side faces of the recess portion, and iii) a locking member configured to lock the plug into the socket, expanding the pair of the connecting members outward so as to contact each of the outer side faces of the connecting members onto a corresponding one of the inner side faces of the recess portion by inserting between the pair of the connecting members via the through-hole, and thereby bringing the plug contacts into contact with the socket contacts.

21 Claims, 5 Drawing Sheets

CONNECTOR AND METHOD OF CONNECTING THE SAME

BACKGROUND OF THE INVENTION

1. Field of the Invention

The present invention relates to a connector and a method of connecting the connector, and particularly to a connector mounted on a printed wiring board and a method of connecting the connector.

2. Description of the Related Art

A connector has heretofore been used as means which connects electrical circuits formed respectively on printed wiring boards to each other. FIG. 4 is a perspective view showing a configuration of a conventional connector. A connector 100 includes a male plug 101 and a female socket (a receptacle) 103. The plug 101 is mounted on a surface of a printed wiring board 105, and the socket 103 is mounted on a surface of another printed wiring board 106. The plug 101 includes a plurality of contacts (connections) 102 used for electrical connection on each of outer side faces 101*a* of the plug 101. On the other hand, the socket 103 includes a plurality of contacts (connections) 104 used for the electrical connection on each of inner side faces 103*a* of the socket 103.

Next, descriptions will be given of a method of connecting the plug 101 to the socket 103. FIGS. 5A and 5B are cross-sectional views showing a procedure for connecting the plug 101 to the socket 103 of the connector 100 shown in FIG. 4. FIGS. 5A and 5B are cross-sectional views each taken along the line V-V in FIG. 4. Firstly, as shown in FIG. 5A, a male portion of the plug 101 is arranged so as to face a female portion of the socket 103. Next, as shown in FIG. 5B, the male portion of the plug 101 is inserted into the female portion of the socket 103. Accordingly, each of the contacts 102 and a corresponding one of the contacts 104 are connected to each other, i.e., come into contact with each other.

In a connector, it is generally required to reduce contact resistance between contacts on the plug and contacts on the socket for the purpose of reducing electrical losses in the connection between the plug and the socket. The gap between the contacts 102 and the contacts 104 in the connector 100 is made small enough to fulfill the requirement. However, in such a structure, when the plug 101 is inserted into the socket 103, an edge of any one of the contacts 102 may possibly abut on an edge of the corresponding one of the contacts 104. FIG. 6 is a cross-sectional view showing a problem associated with a conventional connector. When an edge of any one of the contacts 102 abuts on an edge of the corresponding one of the contacts 104 as described above, each of the contacts 104 of the socket 103 may possibly be crushed and thereby deformed, as indicated by reference numeral 111. In addition, even when an edge of each of the contacts 102 does not abut on an edge of the corresponding one of the contacts 104, each of the contacts 104 may possibly be deformed due to a friction applied to the surface of the contacts 102 and the surface of the contacts 104. Moreover, the contacts 104, if not deformed, may possibly be damaged. It should be noted that, not only the contacts 104 but also the contacts 102 of the plug 101 may possibly be crushed or deformed. For this reason, a conventional connector has a problem of reliability at the time of connection.

For the purpose of solving the above described problem, for example, a configuration as shown in FIG. 7 has been proposed. In the configuration shown in FIG. 7, upper portions of contacts 204 of a socket 203 are bent outward. The bending of the upper portions of the contacts 204 outward is a countermeasure taken to prevent an edge of each of the contacts 102 of the plug 101 from abutting on an edge of a corresponding one of the contacts 204 of the socket 203 when a plug 101 is inserted into the socket 203. In addition, in the related document 1 "Japanese Patent Application Laid-Open No. 2006-86083", particularly, in FIGS. 3 and 4, a connector having a configuration similar to that of the connector shown in FIG. 7 is disclosed. In this configuration, edge portions of contacts of a socket (receptacle) are bent outward so as to prevent edge faces of contacts of the plug from abutting respectively on edge faces of the contacts of the socket.

However, in recent years, a connector mounted on a printed wiring board has been downsized more than ever as an electronic circuit on the printed wiring board has been miniaturized. For this reason, the surface area of each contact has necessarily been reduced. In order to suppress increase in contact resistance between contacts associated with the reduction in the surface area of each contact, it is required to further increase contact pressure between the contacts. For this reason, even in the connector shown in FIG. 7 and in the connector disclosed in the related document 1, a large friction may be generated between one of the contacts of the plug and the corresponding one of the contacts of the socket when the plug is inserted into the socket. Accordingly, a large mechanical stress may possibly be generated between the contact of the plug and the corresponding contact of the socket. As a result, the contacts may possibly be deformed or damaged. Moreover, in the configuration shown in FIG. 7 and the configuration disclosed in the related document 1, when the connector is repeatedly attached and detached, the contacts on both sides may be rubbed with each other and thus wear so that contact pressure may possibly be decreased. As a result, a problem may occur in which electrical connection loss is increased due to an increase in contact resistance. Moreover, in the configuration disclosed in the related document 1, the contacts on both sides are brought into contact with each other by means of the spring-like characteristic of the contacts. For this reason, contact pressure may possibly be reduced due to the passage of time.

Accordingly, a problem may occur in which electrical losses in the connection is increased due to increase in contact resistance. As described above, the aforementioned connectors have problems in assurance and reliability at the time of connection.

SUMMARY OF THE INVENTION

In view of the foregoing and other exemplary problems, drawbacks, and disadvantages of the related art methods and structures, exemplary feature of the present invention is to provide a connector and a method of connecting the connector, with which it is possible to prevent mechanical stress from being generated between contacts when a plug is inserted into a socket.

A connector according to the present invention includes a plug (11) having a first part (31) with an upper surface and a lower surface, a pair of connecting members (12) extending downward from the lower surface, a set of plug contacts (13) located on an outer face side (12*a*) of each connecting member, and a through-hole (32) open to the upper surface and extending through to the lower surface, a socket (21) having an upper end face (21*b*), a recess portion (23) open to the upper end face and having a pair of inner side faces (21*a*), a set of socket contacts (22) located on each of the inner side faces, the recess portion configured to accept the connecting members with each of the connecting members facing a corresponding one of the inner side faces and a gap formed between each set of socket contacts and a corresponding set of plug contacts, and a locking member (14) for locking the plug within the socket by insertion of the locking member in an insertion direction, via the through-hole, into the recess portion, the insertion of the locking member pressing outer faces of the locking member against inner faces of the connecting members and thereby expanding the outer face side of each connecting member towards the inner side faces of the socket a distance that eliminates the gap and bringing each set of socket contacts into contact with the corresponding set of plug contacts.

In another expression, a connector according to the present invention includes I) a plug including a pair of connecting members configured to connect the plug to a socket, a through-hole formed at a portion between the pair of connecting members, and plug contacts arranged on outer side faces of the respective connecting members, ii) a socket including a recess portion configured to receive the plug, and socket contacts arranged on inner side faces of the recess portion, and iii) a locking member configured to lock the plug into the socket, expanding the pair of the connecting members outward so as to contact each of the outer side faces of the connecting members onto a corresponding one of the inner side faces of the recess portion by inserting between the pair of the connecting members via the through-hole, and thereby bringing the plug contacts into contact with the socket contacts.

A method of electrically connecting a plug into a socket according to the present invention, the method includes inserting a pair of connecting members of a plug into a recess portion of a socket, inserting a locking member into a through-hole formed between the pair of connecting members, and pressing the locking member in an insertion direction between the pair of connecting members and into the recess portion to bend outward the connecting members with the insertion direction movement of the locking member into the recess portion. The bending outward of the connecting members I) presses outer side faces of the connecting members respectively onto inner side faces of the recess portion, and ii) brings plug contacts arranged on the outer side faces of the connecting members into contact respectively with socket contacts arranged on the inner side faces of the recess portion, and thereby electrically connecting the plug contacts respectively to the socket contacts.

Accordingly, the connector and the method of connecting the connector according to the present invention provide the following effects by employing the above described configurations and method. More specifically, it is possible to prevent mechanical stress from being generated between contacts when a plug is inserted into a socket, and thus to prevent a contact from being damaged. As a result, the connector and the method of connecting the connector according to the present invention further provide an effect in which it is possible to improve assurance and reliability at the time of connection.

BRIEF DESCRIPTION OF THE DRAWINGS

The preferred embodiments, features and advantages of the present invention will become more apparent from the following detailed description when taken in conjunction with the accompanying drawings wherein.

DETAILED DESCRIPTION OF PREFERRED EMBODIMENTS

Preferred embodiments for carrying out the present invention will be described in detail below with reference to the drawings. The preferred embodiments described below show only illustrative examples in understanding the present invention, and the claims of the invention are not limited to these preferred embodiments.

Descriptions of a preferred embodiment of a connector and a method of connecting the connector according to the present invention will be given below.

Firstly, descriptions of a configuration of a connector according to an embodiment of the present invention will be given in detail below.

Figure 1:
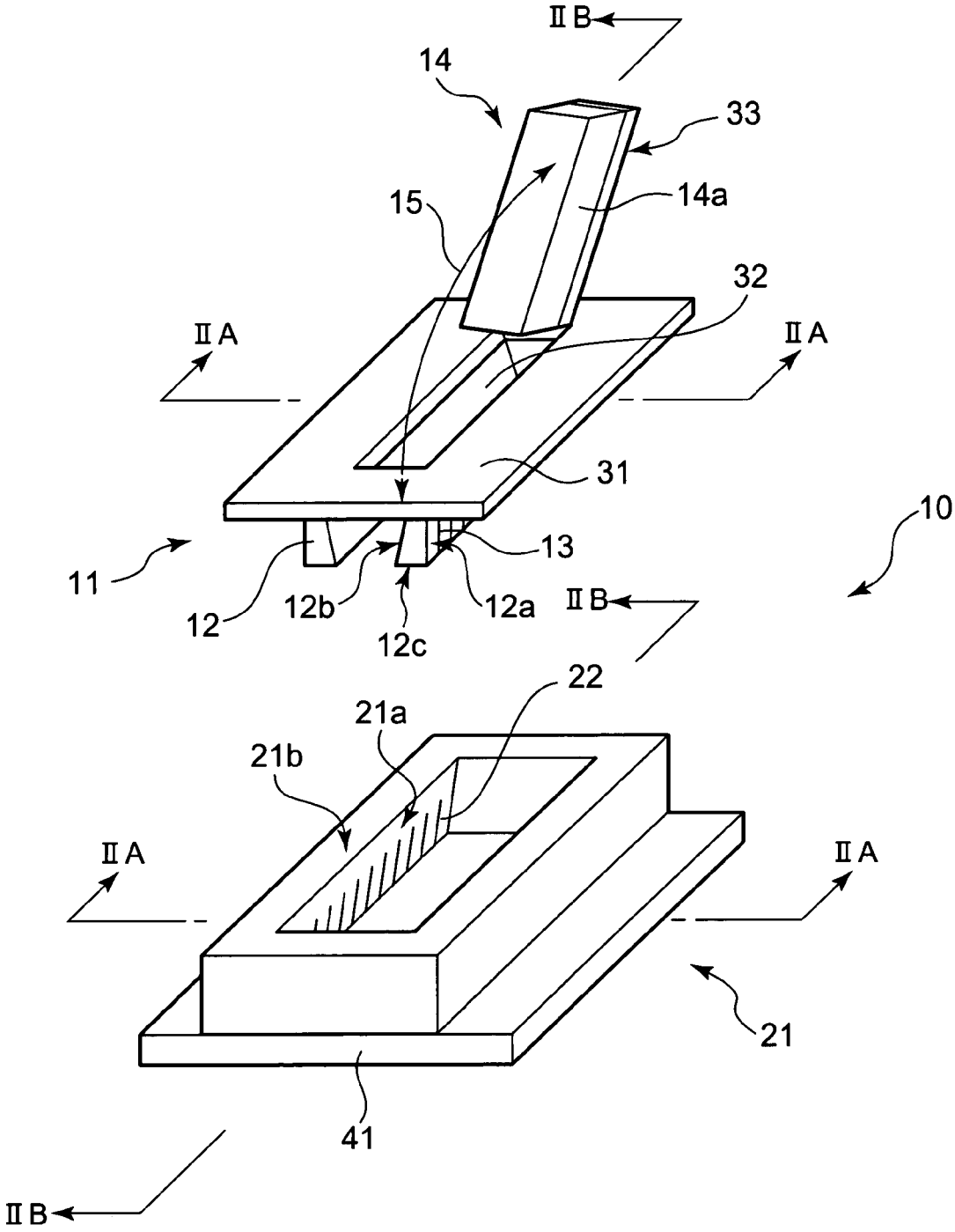
FIG. 1 is a perspective view showing a configuration of a connector according to an embodiment of the present invention.
Figure 2A:
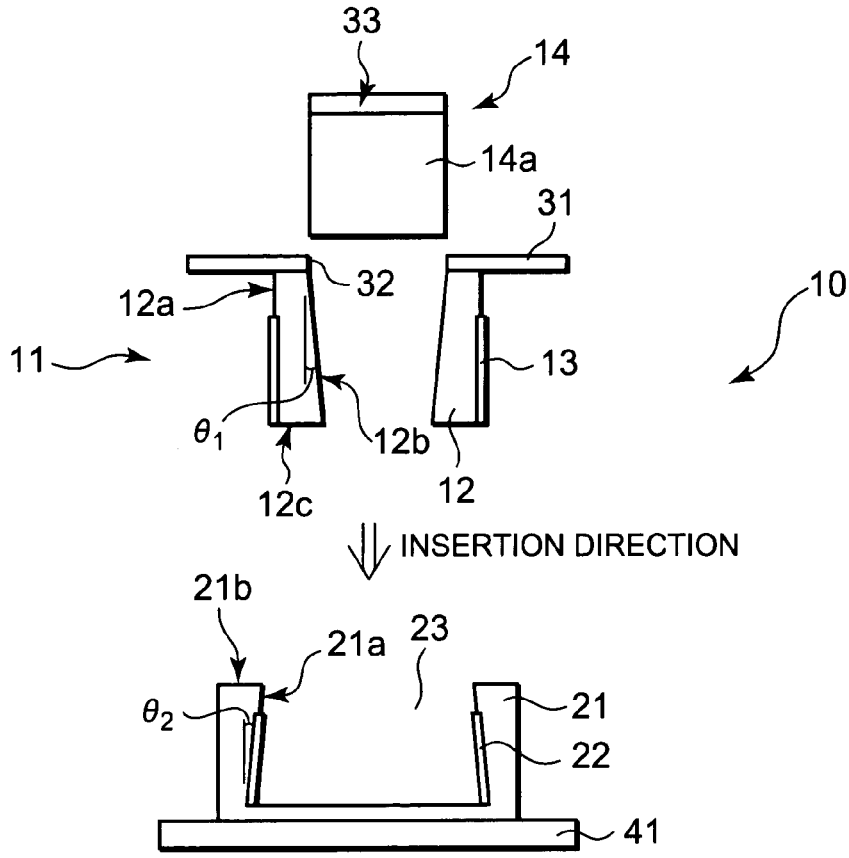
FIG. 2A is a cross-sectional view taken along the line IIA-IIA in FIG. 1.
Figure 2B:
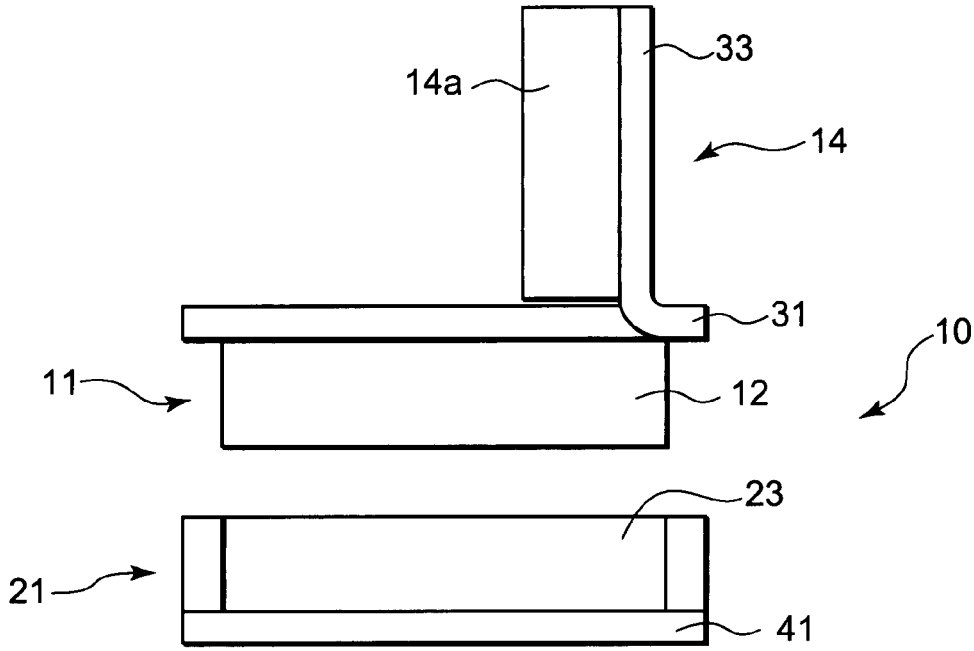
FIG. 2B is a cross-sectional view taken along the line IIB-IIB in FIG. 1.

FIG. 1 is a perspective view showing a configuration of a connector according to an embodiment of the present invention. FIG. 2A is a cross-sectional view taken along the line IIA-IIA in FIG. 1. FIG. 2B is a cross-sectional view taken along the line IIB-IIB in FIG. 1. A connector 10 includes a plug 11, a socket 21 and a locking member 14 for locking the plug 11 into the socket 21. The plug 11 is mounted on a surface of a printed wiring board 31, while the socket 21 is mounted on a surface of another printed wiring board 41. Each of the printed wiring boards 31 and 41 may be any one of a flexible printed wiring board, a rigid printed wiring board, or a rigid flexible printed wiring board. It should be noted that in the embodiment, a case where the connector 10 is bilaterally symmetric is taken as an example. Accordingly, in FIG. 2A, each reference numeral is provided on only one side of the connector 10. In addition, a direction in which the plug 11 is inserted into the socket 21 is shown by an arrow in FIG. 2A (hereinafter referred to as an insertion direction).

The plug 11 includes connecting members 12, a through-hole 32 and a plurality of plug contacts (connections) 13. The connecting members 12 are arranged side by side in two rows. The through-hole 32 is formed between the connecting members 12. The plurality of plug contacts 13 is arranged on an outer side face 12*a* of each of the connecting members 12. In addition, each of the connecting members 12 is flexible. Moreover, the connecting members 12 may be a pair of elongated members which extend in parallel to each other. Each plurality of plug contacts 13 is arranged in a line along a direction in which the outer side faces 12*a* of the connecting members 12 extend. In addition, each of the plurality of plug contacts 13 is connected to a circuit on the printed wiring board 31. The through-hole 32 is formed by cutting out a part of the printed wiring board 31 so as to be located between the pair of connecting members 12. The through-hole 32 has a rectangular shape, for example. Moreover, as shown in FIG. 2A, the width of the through-hole 32 is substantially-equal to the width between inner side faces 12*b* of the connecting members 12 in a portion where the connecting members 12 are attached to the printed wiring board 31. In other words, inner side faces of the through-hole 32 continue respectively to the inner side faces 12*b* of the connecting members 12. The connecting members 12 shown in FIG. 2A are formed of two separate parts respectively on the right and left sides. However, it should be noted that the connecting members 12 may be integrally formed in a manner that the connecting members 12 on the right and left sides are joined to each other at the front and back sides of the through-hole 32 so as to be formed into one connecting member. Then, the through-hole 32 may be formed in the middle portion of the integrated connecting members 12.

In the plug 11, each of the outer side faces 12*a* of the connecting members 12 is formed in the same direction as the insertion direction. In other words, each of the outer side faces 12*a* of the connecting members 12 is formed approximately perpendicular to the printed wiring board 31. On the other hand, the inner side faces 12*b* of the connecting members 12 are formed in a manner that each of the inner side faces 12*b* is inclined at an angle of θ1 with respect to the insertion direction. In other words, the inner side faces 12*b* of the connecting members 12 are formed in a manner that each of the inner side faces 12*b* is inclined at the angle of θ1 with respect to a plane perpendicular to the printed wiring board 31. Accordingly, the width distance between the inner side faces 12*b* of the connecting members 12 gradually decreases from a portion adjacent the printed wiring board 31, so that the lower edge faces 12*c* of the respective connecting members 12 have the narrowest width distance.

The locking member 14 includes a main body 14*a* and a top section 33. The top section 33 is joined to the printed wiring board 31 at one side of the top section 33, as shown in FIG. 2B. In the case where the printed wiring board 31 is a flexible printed wiring board, the printed wiring board 31 has flexibility. Therefore, the top section 33 may be formed by cutting the printed wiring board 31 along three lines corresponding to three sides of the top section 33 except the one side. The top section 33 is joined to the printed wiring board 31 by that one side with flexibility. With such a configuration, it is possible to effectively use, as the top section 33, a part that is cut out of the printed wiring board 31 for the purpose of forming the through-hole 32. In the case where the printed wiring board 31 is a rigid printed wiring board, the top section 33 is joined to the printed wiring board 31 with another flexible member interposed in-between. As described above, since the top section 33 is joined to the printed wiring board 31, it is possible to prevent the locking member 14 from being lost. In addition, the operability is also improved. The main body 14*a* and the top section 33 of the locking member 14 are fixed to each other with an adhesive or the like. In addition, the width of the locking member 14 is substantially the same as the width of the through-hole 32. In other words, the width of the locking member 14 is substantially the same as the width between the inner side faces 12*b* in a portion where the connecting members 12 are attached to the printed wiring board. 31. Incidentally, the locking member 14 may have an elongated shape, as shown in FIG. 1. The bottom face of the locking member 14 has substantially the same shape as the through-hole 32. The locking member 14 can be rotated about the portion where the locking member 14 is joined to the printed wiring board 31, as indicated by reference numeral 15 in FIG. 1. By rotating the locking member 14 in this manner, the locking member 14 can be inserted into a space between the pair of connecting members 12 via the through-hole 32. It should be noted that the locking member 14 may be formed of only the main body 14*a* without the top section 33. In addition, the locking member 14 may not be joined to the printed wiring board 31.

The socket 21 includes a recess portion 23 and a plurality of socket contacts (connections) 22. The recess portion 23 is configured so as to be able to house the pair of connecting members 12 of the plug 11. Each plurality of socket contacts 22 is arranged on one of the inner side faces 21*a* of the recess portion 23. In addition, the plurality of socket contacts 22 is each arranged in lines along a longitudinal direction of the inner side faces 21*a* of the recess portion 23. Moreover, each of the plurality of socket contacts 22 is connected to a circuit formed on the printed wiring board 41. The socket 21 does not have flexibility. As shown in FIG. 2A, the width of the opening of the recess portion 23 is substantially equal to the distance between the outer side faces 12*a* of the pair of connecting members 12. In addition, the width distance of the recess portion 23 gradually increases from the narrowest width distance at the opening to the widest width distance at a portion adjacent the printed wiring board 41.

Moreover, in the socket 21, each of the inner side faces 21*a* is formed in a manner that each of the inner side faces 21*a* is inclined at an angle of θ2 with respect to the insertion direction. In other words, each of the inner side faces 21*a* of the socket 21 is formed in a manner that each of the inner side faces 21*a* is inclined at the angle of θ2 with respect to a plane perpendicular to the printed wiring board 41 (or perpendicular to the bottom face of the recess portion 23). The distance between the pair of inner side faces 21*a* gradually increases, from the smallest distance at a portion corresponding to the upper end faces 21*b* to the largest distance at a portion adjacent the printed wiring board 41 (or at the bottom face of the recess portion 23). The inclination angle θ2 of each of the inner side faces 21*a* of the socket 21 has substantially the same absolute value as that of the inclination angle θ1 of each of the inner face sides 12*b* of the connecting members 12. Adjusting the absolute values of the respective inclination angles θ1 and θ2, the plug 11 can be made less likely to come out of the socket 21. More specifically, the larger the absolute values are made, the more difficult it is for the plug 11 to come out of the socket 21. However, each of the absolute values of the inclination angles θ1 and θ2 needs to be within a range with which the connecting members 12 can be elastically deformed. Moreover, by adjusting the difference between the inclination angles θ1 and θ2, it is possible to adjust the contact pressure between each of the plurality of plug contacts 13 and a corresponding one of the plurality of socket contacts 22. More specifically, the larger the inclination angle θ1 is made as compared with the inclination angle θ2, the larger the contact pressure becomes. In this way, the contact pressure between each of the plurality of plug contacts 13 and a corresponding one of the plurality of socket contacts 22 can be appropriately adjusted to an appropriate value. By forming the plug 11 and the socket 21 respectively into such shapes, when the connecting members 12 are bent outward (respectively in the right and left directions), the outer side faces 12*a* of the connecting members 12 abut respectively on the inner side faces 21*a* of the recess portion 23. Accordingly, each of the inner side faces 12*b* of the connecting members 12 becomes perpendicular to the printed wiring boards 31 and 41. In addition, the length of the recess portion 23 of the socket 21 in the longitudinal direction is substantially the same as that of each of the connecting members 12 in the longitudinal direction.

The height of the locking member 14 is substantially the same as that obtained by adding the height of the printed wiring board 31 and the height of each of the connecting members 12. In other words, the height of the locking member 14 is substantially equal to the distance from the upper face of the printed wiring board 31 to the lower edge face 12*c* of each of the connecting members 12. The height of each of the connecting members 12 of the plug 11 is about equal to the depth of the recess portion 23 of the socket 21. However, the height of each of the connecting members 12 is slightly shorter than the distance from the upper end face 21*b* of the socket 21 to the bottom face of the recess portion 23. This is for the purpose of avoiding the lower edge face 12*c* of each of the connecting members 12 from rubbing against the bottom face of the recess portion 23 when the connecting members 12 are bent outward. In addition, the lower edge face 12*c* of each of the connecting members 12 may be inclined in a manner that the inner side face 12*b* is shorter than that shown in FIG. 2A in each of the connecting members 12. With this configuration, the lower edge face 12*c* of each of the connecting members 12 is unlikely to rub against the bottom face of the recess portion 23 when the connecting members 12 are bent outward (respectively in the right and left directions).

It should be noted that the locking member 14 and the socket 21 are preferably made of a rigid material with limited flexibility, and the connecting members 12 of the plug 11 are made of a flexible and deformable material. More specifically, as a material for the locking member 14 and the socket 21, a synthetic resin or a plastic, each being largely inflexible, may be used, for example. As a material for the connecting members 12 of the plug 11, it is possible to use an elastic synthetic resin or a soft plastic, such as nylon, glass-filled nylon, PPS (Poly Phenylene Sulfide), glass-filled PPS or PBT (Poly Buthylene Terephthalete), for example. The plug contacts 13 and the socket contacts 22 are made of a metal, such as copper, tin, gold, silver or nickel; or an alloy thereof. In addition, the connecting members 12 are fixed to the printed wiring board 31 with an adhesive, and the socket 21 may be also fixed to the printed wiring board 41 with an adhesive.

Figure 3A:
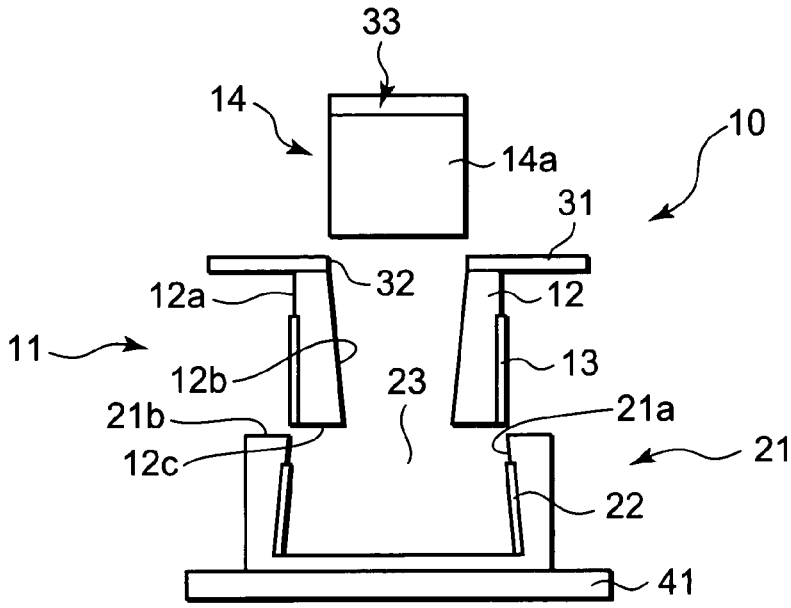
FIGS. 3A, 3B and 3C are cross-sectional views showing a procedure for connecting a plug to a socket in the connector shown in FIG. 1.
Figure 3B:
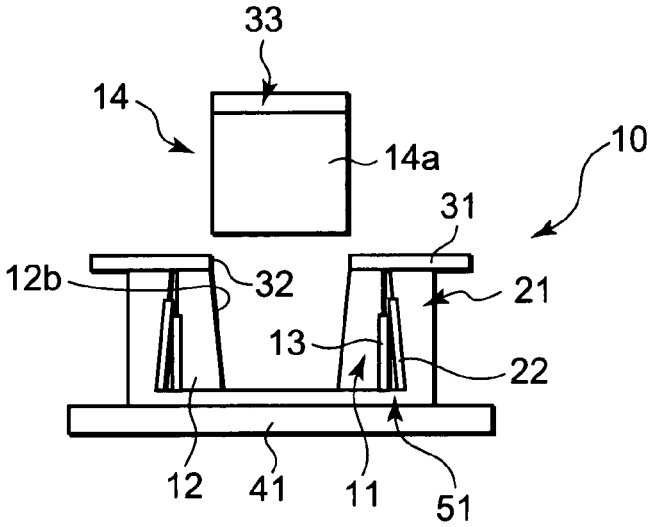
Figure 3C:
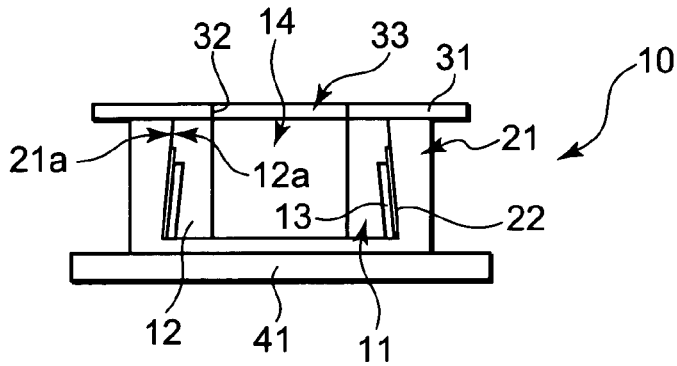

Next, descriptions of a method of connecting the connector according to the embodiment of the present invention will be given in detail. FIGS. 3A, 3B and 3C are cross-sectional views showing a procedure for connecting a plug to a socket in the connector shown in FIG. 1.

Firstly, as shown in FIG. 3A, the plug 11 is placed so as to make the connecting members 12 face the recess portion 23 of the socket 21 in a state where the locking member 14 is separated from the plug 11.

Next, as shown in FIG. 3B, the connecting members 12 of the plug 11 are inserted into the recess portion 23 of the socket 21. At this time, since the inner side faces 21*a* of the socket 21 are inclined, the outer side faces 12*a* of the connecting members 12 are not brought into full contact respectively with the inner side faces 21*a*. For this reason, a gap 51 is formed between each of the plug contacts 13 and a corresponding one of the socket contacts 22. Accordingly, each of the plug contacts 13 and the corresponding one of the socket contacts 22 do not fully contact to each other. As a result, when the plug 11 is inserted into the socket 21, mechanical stress is not generated between each of the plug contacts 13 and the corresponding one of the socket contacts 22.

Subsequently, as shown in FIG. 3C, the locking member 14 has been inserted between the pair of connecting members 12 via the through-hole 32 of the plug 11. At this time, side faces of the locking member 14 abut respectively on the inner side faces 12*b*, each of which is inclined, of the connecting members 12, and thereby press the inner side faces 12*b* outward. Accordingly, the pair of connecting members 12 is expanded outward (respectively in the right and left directions). As described above, the inclination angle θ1 of each of the inner face sides 12*b* of the connecting members 12 has substantially the same absolute value as that of the inclination angle θ2 of each of the inner side faces 21*a* of the recess portion 23. In addition, each of the outer side faces 12*a* of the connecting members 12 is formed approximately perpendicular to the printed wiring boards 31 and 41. For this reason, the outer side faces 12*a* of the connecting members 12 are brought into contact respectively with the inner side faces 21*a* of the recess portion 23 in a state where the locking member 14 is fully inserted between the pair of connecting members 12. Therefore, the plug contacts 13 are brought into contact respectively with the socket contacts 22 with an appropriate pressure. As a result, electrical connection is achieved between the plug 11 and the socket 21.

The plug 11 is detached from the socket 21 in the reverse procedure to that of the attaching of the plug 11 that has been described above. More specifically, the locking member 14 is firstly removed from between the pair of connecting members 12 via the through-hole 32. The locking member 14 can be removed from the through-hole 32 by, for example, lifting up the top section 33 with a tool or the like. Once the locking member 14 is removed, the connecting members 12 return to the original shape as shown in FIG. 3B since the locking member 14 is elastic. As the connecting members 12 return to the original shape, the plug contacts 13 are separated respectively from the socket contacts 22. Next, the plug 11 is removed from the socket 21, and thereby the connector 10 returns to the state shown in FIG. 3A. Accordingly, since the gap 51 exists between the plug contacts 13 and the socket contacts 22 when the plug 11 is removed from the socket 21, mechanical stress is not generated.

The connector and the method of connecting the connector according to the embodiment of the present invention provide the following effects.

According to the connector 10 of this embodiment, when the plug 11 is inserted into the socket 21, the plug contacts 13 of the plug 11 are not brought into contact respectively with the socket contacts 22 of the socket 21. This makes it possible to prevent mechanical stress from being generated between the plug contacts 13 and the corresponding socket contacts 22. Therefore, the connector 10 of this embodiment make it possible to prevent the plug contacts 13 of the plug 11 and the socket contacts 22 of the socket 21 from being deformed, wearing and being broken. Moreover, even in a case where the connection and disconnection of the connector is repeated, it is possible to prevent the contacts of the plug and the socket from being rubbed with each other and the wearing, and thus to reduce in the contact pressure between the contacts. As a result, it is possible to prevent increase in the electrical losses in the connection between the contacts due to increase in the contact pressure.

Figure 4:
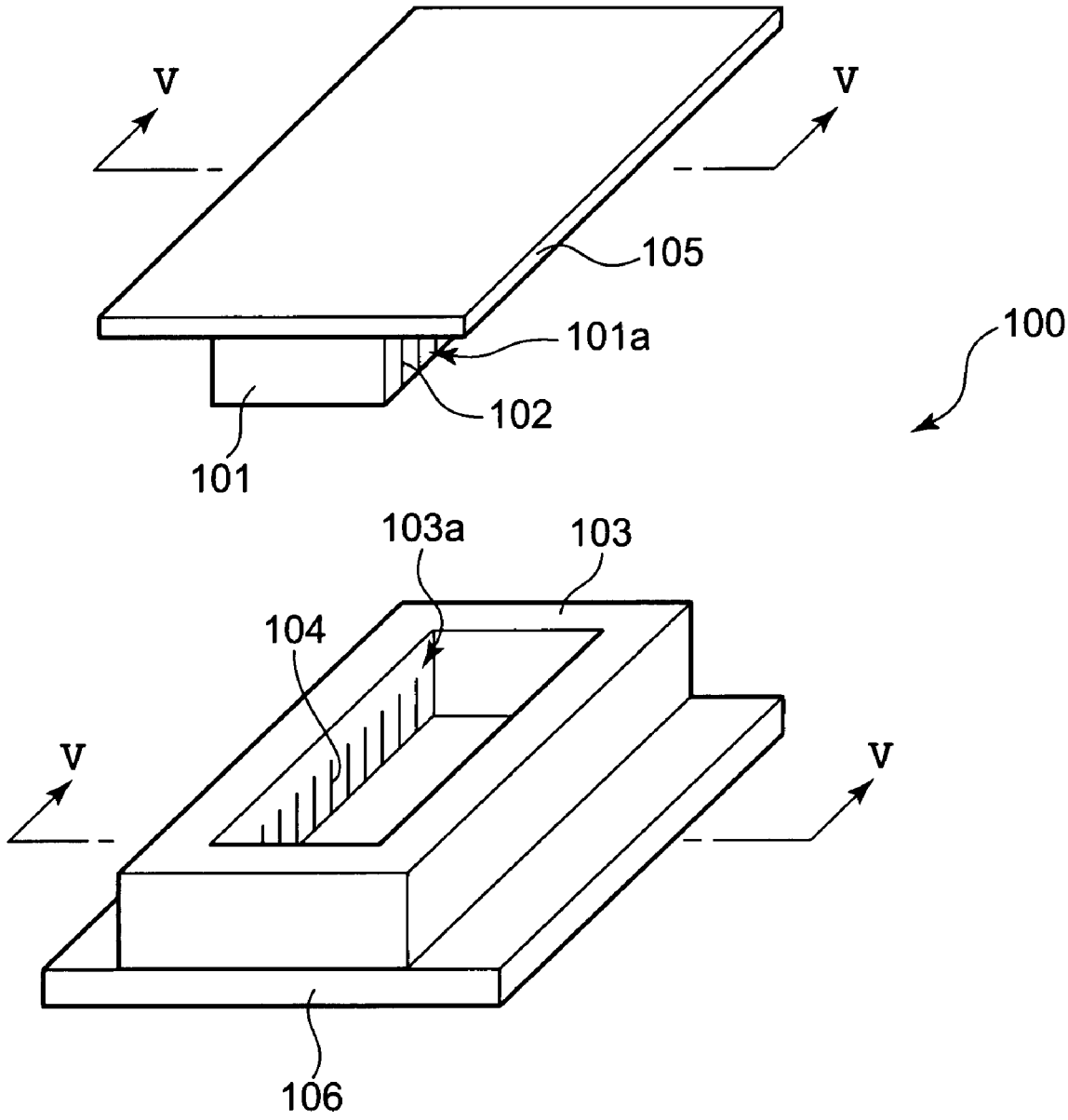
RELATED ART Fig. 4
FIG. 4 is a perspective view showing a configuration of a conventional connector.
Figure 5A:
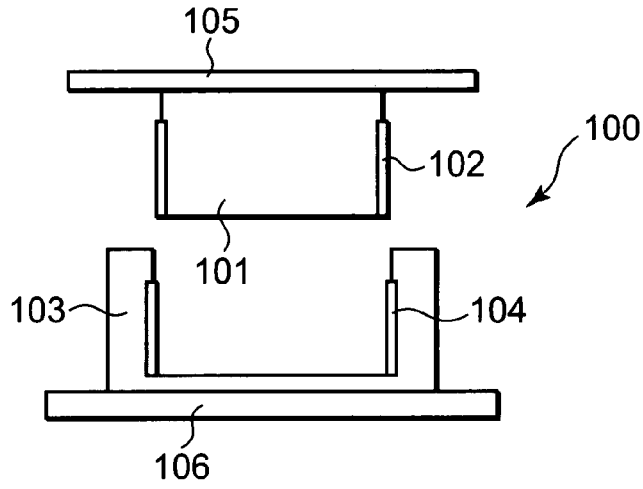
Fig. 5A RELATED ART
FIGS. 5A and 5B are cross-sectional views showing a procedure for connecting a plug to a socket in the connector shown in FIG. 4.
Figure 5B:
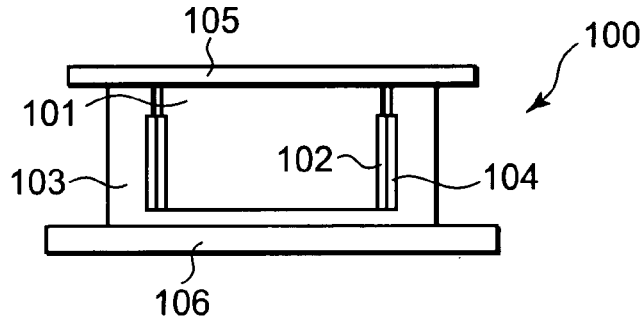
Fig. 5B RELATED ART
Figure 6:
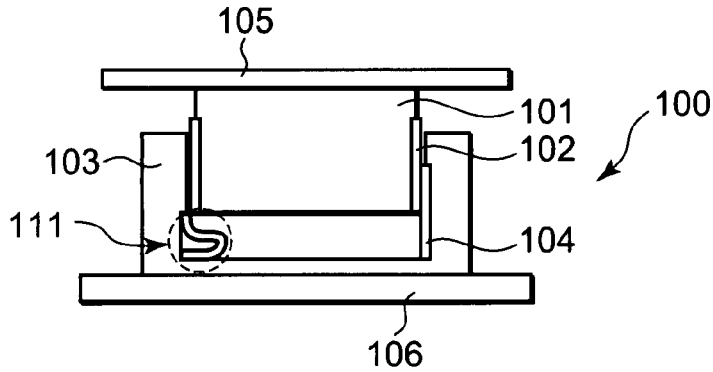
Fig. 6 RELATED ART
FIG. 6 is a cross-sectional view showing a problem associated with the conventional connector.
Figure 7:
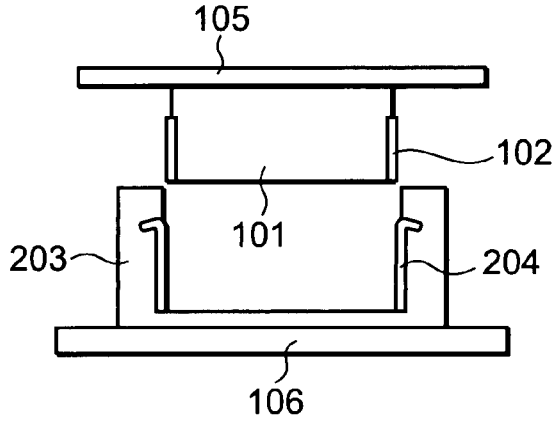
Fig. 7 RELATED ART
FIG. 7 is a cross-sectional view showing an example of a countermeasure against the problem associated with the conventional connector.

In addition, as shown in FIG. 3C, when the locking member 14 is inserted between the pair of connecting members 12, each of the outer side faces 12*a* of the connecting members 12 is pressed to expand outward more greatly as approaching the lower edge portions 12*c*. Accordingly, the plug is not easily pulled out of the socket as compared with the connectors shown in FIGS. 4 and 7. As a result, even in a case where the connector is vibrated, it is possible to prevent the plug from being dropped out of the socket.

Moreover, the locking member 14 presses the pair of connecting members 12 respectively onto the inner side faces 21*a* of the socket 21. Accordingly, contact pressure between the plug contacts 13 and the socket contacts 22 is enhanced. As a result, it is possible to sufficiently reduce the contact resistance between the plug contacts 13 and the socket contacts 22.

Furthermore, in the connector 10 according to the present embodiment, each of the plug contacts 13 and the corresponding one of the socket contacts 22 are not elastically brought into contact with each other. For this reason, the connector according to the present embodiment is resistant to deterioration with the passage of time, and thus the contact pressure can be prevented from being reduced. As a result, it is possible to prevent increase in electrical connection loss due to increase in contact resistance.

As described above, the connector and the method of connecting the connector according to the present embodiment have an effect in improving assurance and reliability at the time of connection.

While the present invention has been described in connection with certain preferred embodiment, it is to be understood that the subject matter encompassed by way of the present invention is not to be limited to the specific embodiment. On the contrary, it is intended for the subject matter of the invention to include all alternatives, modifications and equivalents as can be included within the spirit and scope of the following claims.

Further, the inventor's intent is to retain all equivalents of the claimed invention even if the claims are amended later during prosecution.

What is claimed is:

1. A connector, comprising:

a plug (11) having a first part (31) with an upper surface and a lower surface, a pair of connecting members (12) extending downward from the lower surface, a set of plug contacts (13) located on an outer face side (12*a*) of each connecting member, and a through-hole (32) open to the upper surface and extending through to the lower surface;

a socket (21) having an upper end face (21*b*), a recess portion (23) open to the upper end face and having a pair of inner side faces (21*a*), a set of socket contacts (22) located on each of the inner side faces, the recess portion configured to accept the connecting members with each of the connecting members facing a corresponding one of the inner side faces and a gap formed between each set of socket contacts and a corresponding set of plug contacts; and a locking member (14) for locking the plug within the socket by insertion of the locking member in an insertion direction, via the through-hole, into the recess portion, the insertion of the locking member pressing outer faces of the locking member against inner faces of the connecting members and thereby expanding the outer face side of each connecting member towards the inner side faces of the socket a distance that eliminates the gap and bringing each set of socket contacts into contact with the corresponding set of plug contacts.

2. The connector according to claim 1, wherein, a distance between inner side faces of the connecting members decreases from a largest distance, at upper ends of the connecting members, to a smallest distance at the lower ends of the connecting members, and prior to insertion in the socket, a distance between the outer side faces of the connecting members is uniform.

3. The connector according to claim 1, wherein, the distance between the inner side faces of the recess portion of the socket at an opening portion of the recess portion is approximately equal to the distance between the outer side faces of the connecting members, and the distance between the inner side faces of the recess portion increases from a narrowest distance at the opening portion to the widest distance at a bottom face of the recess portion.

4. The connector according to claim 1, wherein, each of the inner side faces of the connecting members is inclined at a first angle with respect to an insertion direction in which the plug is inserted into the socket, each of the outer side faces of the connecting members is parallel to the insertion direction, each of the inner side faces of the recess portion is inclined at a second angle with respect to the insertion direction, and the first angle has substantially the same absolute value as that of the second angle.

5. The connector according to claim 1 wherein the width of the through-hole is substantially the same as the distance between the inner side faces of the connecting members at the upper ends of the connecting members.

6. The connector according to claim 1 wherein each of the inner side faces of the through-hole continues to a corresponding one of the inner side faces of the connecting members.

7. The connector according to claim 1 wherein the width of the locking member is substantially the same as the width of the through-hole.

8. The connector according to claim 1 wherein the width of the opening portion of the recess portion is substantially the same as the distance between the outer side faces of the connecting members.

9. The connector according to claim 1 wherein the pair of the connecting members is a pair of elongated members which extend in parallel to each other.

10. The connector according to claim 9 wherein the plug contacts are arranged in lines along a direction in which the outer side faces of the connecting members extend.

11. The connector according to claim 1 wherein the socket contacts are arranged in lines along a longitudinal direction of the inner side faces of the recess portion.

12. The connector according to claim 1 wherein each of the connecting members is made of an elastic material.

13. The connector according to claim 1 wherein the locking member is made of a rigid material.

14. The connector according to claim 1 further comprising:

a first printed wiring board on which the plug is configured to be mounted; and a second printed wiring board on which the socket is configured to be mounted.

15. The connector according to claim 14 further comprising a joining member that joins the locking member to the first printed wiring board.

16. The connector according to claim 15 wherein the joining member is made of a soft material.

17. The connector according to claim 14 wherein the through-hole is formed by cutting out a part of the first printed wiring board.

18. The connector according to claim 14 wherein each of the inner side faces of the connecting members is inclined at a first angle with respect to a plane perpendicular to the first printed wiring board, each of the outer side faces of the connecting members is parallel to the plane perpendicular to the first printed wiring board, each of the inner side faces of the recess portion is inclined at a second angle with respect to a plane perpendicular to the second printed wiring board, and the first angle has substantially the same absolute value as that of the second angle.

19. The connector according to claim 14 wherein the first printed wiring board is any one of a flexible printed wiring board, a rigid printed wiring board and a rigid flexible printed wiring board.

20. A connector comprising:

a plug including a pair of connecting members configured to connect the plug to a socket, a through-hole formed at a portion between the pair of connecting members, and plug contacts arranged on outer side faces of the respective connecting members;

a socket including a recess portion configured to receive the plug, and socket contacts arranged on inner side faces of the recess portion; and a locking member configured to lock the plug into the socket, expanding the pair of the connecting members outward so as to contact each of the outer side faces of the connecting members onto a corresponding one of the inner side faces of the recess portion by inserting the locking member between the pair of the connecting members via the through-hole, and thereby bringing the plug contacts into contact with the socket contacts.

21. A method of electrically connecting a plug into a socket, the method comprising:

inserting a pair of connecting members of a plug into a recess portion of a socket;

inserting a locking member into a through-hole formed between the pair of connecting members; and pressing the locking member in an insertion direction between the pair of connecting members and into the recess portion to bend outward the connecting members with the insertion direction movement of the locking member into the recess portion, wherein, the bending outward of the connecting members i) presses outer side faces of the connecting members respectively onto inner side faces of the recess portion, and ii) brings plug contacts arranged on the outer side faces of the connecting members into contact respectively with socket contacts arranged on the inner side faces of the recess portion, and thereby electrically connecting the plug contacts respectively to the socket contacts.

* * * * *